US005101520A

United States Patent [19]

Lockhart

[11] Patent Number: 5,101,520

[45] Date of Patent: Apr. 7, 1992

[54] HEMORRHOID TREATMENT SYSTEM

[76] Inventor: Alonzo E. Lockhart, 12012 S. Compton Ave. #6-217, Los Angeles, Calif. 90059

[21] Appl. No.: 583,020

[22] Filed: Sep. 14, 1990

[51] Int. Cl.[5] ..... E03D 9/08; A47K 3/20; A61H 35/00

[52] U.S. Cl. ..... 4/447; 4/420.4; 4/448

[58] Field of Search ..... 4/443, 420.4, 420.5, 4/420.1, 447, 448, 444

[56] References Cited

U.S. PATENT DOCUMENTS

| | | | |
|---|---|---|---|
| 3,156,929 | 11/1964 | Davis, Jr. | 4/420.4 |
| 3,570,015 | 3/1971 | Rosengaus | 4/420.4 |
| 3,662,407 | 5/1972 | Colucci | 4/448 |
| 3,808,608 | 5/1974 | Caplan | 4/448 |
| 3,925,826 | 12/1975 | Huyot et al. | 4/420.4 |
| 4,092,744 | 6/1978 | Butoi | 4/420.4 |
| 4,304,016 | 12/1981 | Oguma et al. | 4/448 |
| 4,371,993 | 2/1983 | Patrick | 4/448 |
| 4,553,274 | 11/1985 | Yui | 4/420.4 |
| 4,688,275 | 8/1987 | Kuo | 4/420.5 |
| 4,876,750 | 10/1989 | Broyles | 4/420.2 |
| 4,995,121 | 2/1991 | Barker | 4/443 |

FOREIGN PATENT DOCUMENTS

| | | | |
|---|---|---|---|
| 0365342 | 12/1938 | Italy | 4/420.4 |
| 0280139 | 11/1989 | Japan | 4/448 |

*Primary Examiner*—William A. Cuchlinski, Jr.
*Assistant Examiner*—John L. Beres
*Attorney, Agent, or Firm*—Benman & Collins

[57] ABSTRACT

A hemorrhoid treatment system including a tank for storing fluid, a dispenser located in a toilet seat for ejecting the fluid, and a pump for pumping fluid from the tank through the dispenser. In more specific embodiments, the dispenser is positioned to spray any of several fluids on the affected area. The dispenser is pivotally mounted within the seat to allow for storage in convenient location. A switch is provided within the handle of the dispenser for activating a motor associated with the pump. A valve is provided for selecting for ejection water or a fluid from the tank.

9 Claims, 8 Drawing Sheets

FIG. 3(a)
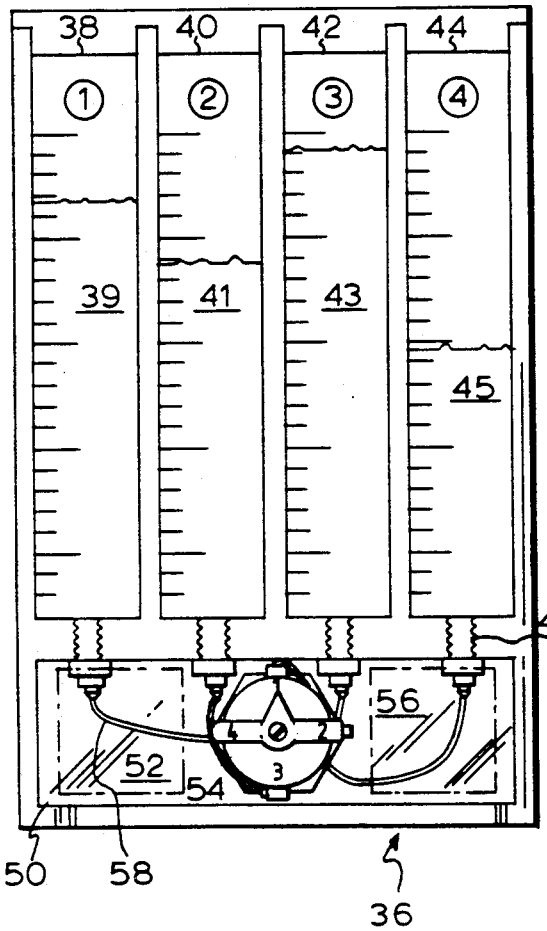
FIG. 3(b)
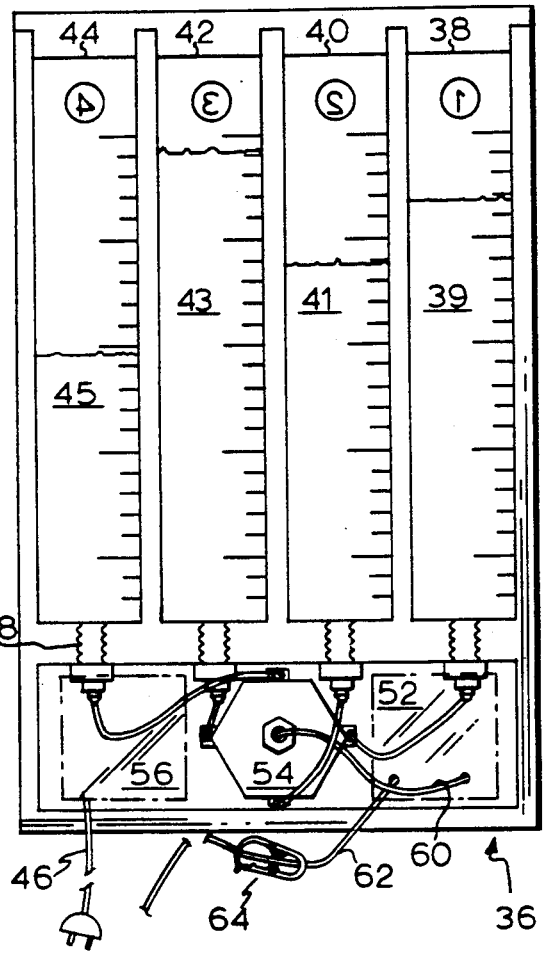
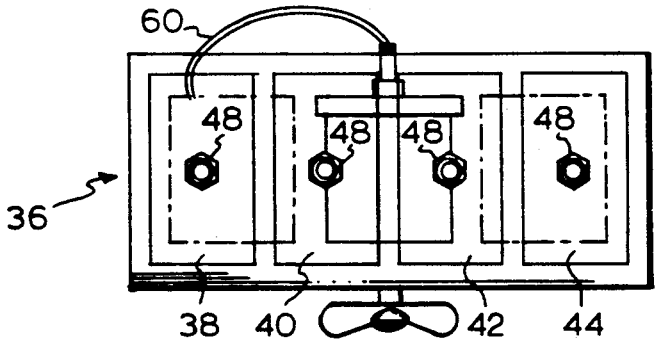
FIG. 3(c)

FIG. 3(d)
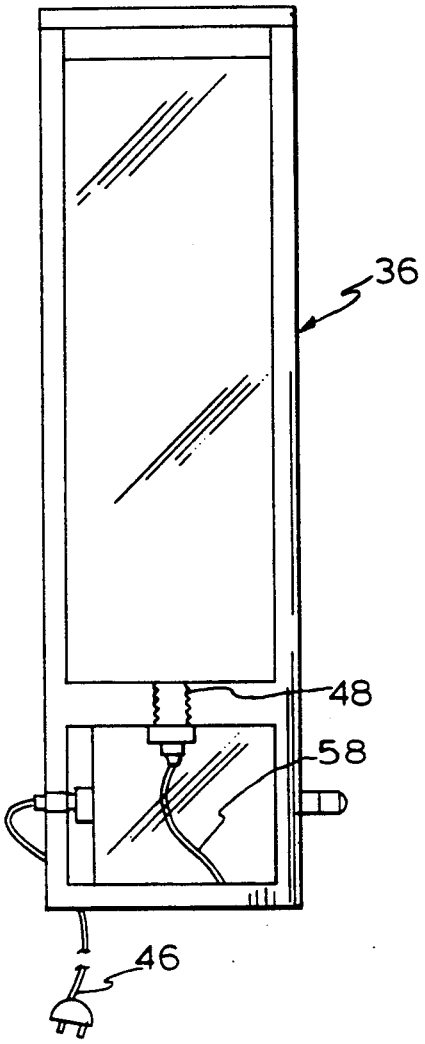
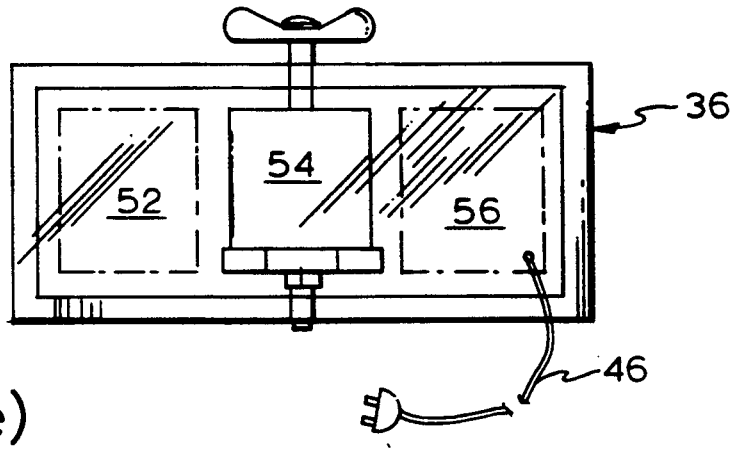
FIG. 3(e)

FIG. 8(a)
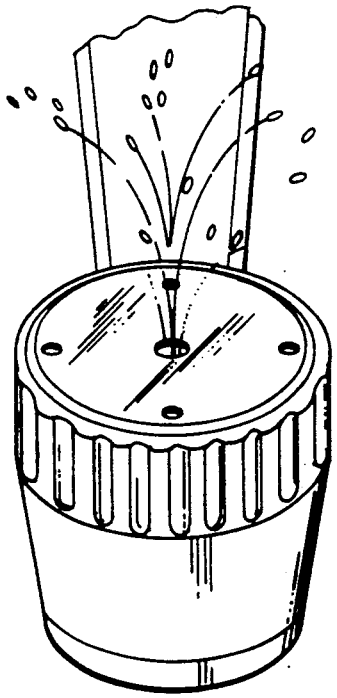
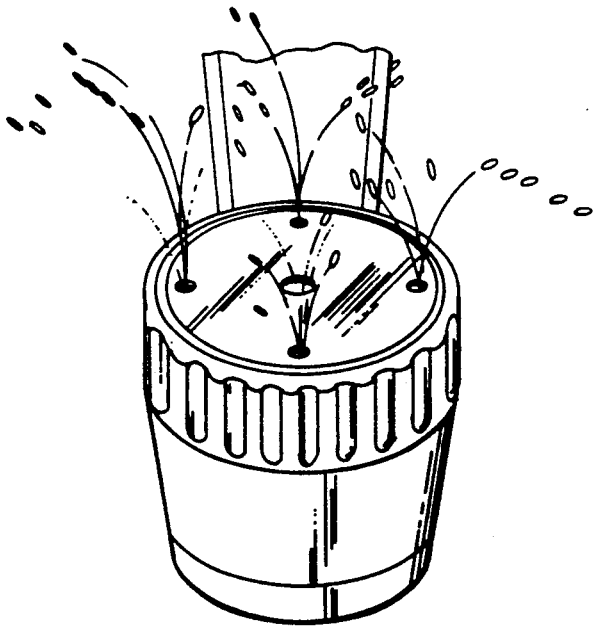
FIG. 8(b)

FIG. 10
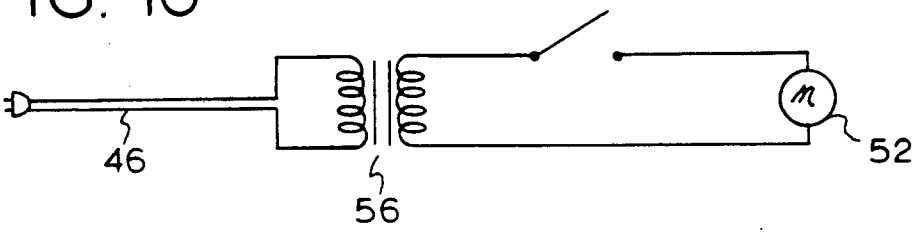
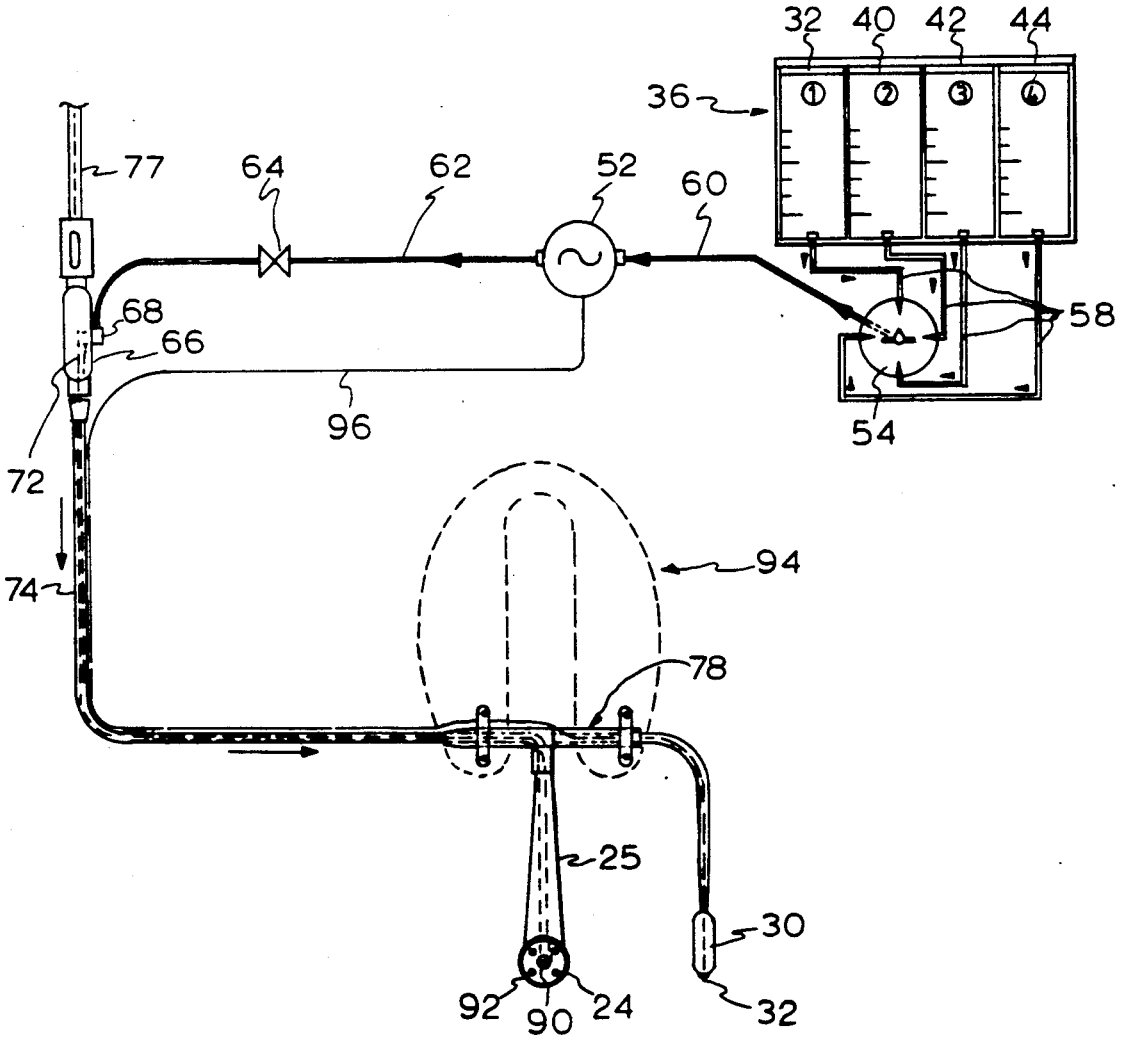
FIG. 9

HEMORRHOID TREATMENT SYSTEM

BACKGROUND OF THE INVENTION

1. Field of the Invention

The present invention relates to medical systems. More specifically, the present invention relates to techniques for treating hemorrhoids.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

A hemorrhoid is a protrusion of the internal intestinal mucosa into the lumen of the rectum and, at times, outside the body. If untreated, a hemorrhoid can be painful and can cause irritation, discomfort, and a soiling of clothing (typically underwear). Further, the untreated hemorrhoid can become thrombose, ulcerate and prone to infection.

One current technique for treating external hemorrhoids involves the topical application of emollients, prescription and other over the counter medications. However, it is generally well accepted within the medical community that the key to proper hemorrhoidal care is to keep the area clean and to minimize inflammation. Emollients and creams tend to trap fecal film and minutia on the surface of the skin. This fecal film and minutia can serve as an additional source of irritation and inflammation. Accordingly, sitz baths are the currently preferred technique for treating uncomplicated hemorrhoids.

Sitz bath treatment involves soaking the affected area in a warm water bath 3 to 4 times per day. However, frequent bathing is impractical and inefficient for the average patient. Further, cold water is now recognized as being more effective in treatment of hemorrhoids than warm water. The obvious discomfort of a cold water bath is a significant limitation on the efficacy of the sitz bath treatment technique.

Accordingly, there is a need in the art for a practical, effective technique for treating hemorrhoids.

SUMMARY OF THE INVENTION

The need in the art is addressed by the hemorrhoid treatment system of the present invention. In a most general sense, the invention includes a tank for storing fluid, a dispenser located in a toilet seat for ejecting the fluid, and a pump for pumping fluid from the tank through the dispenser.

In more specific embodiments, the dispenser is positioned to spray any of several fluids on the affected area. The dispenser is pivotally mounted within the seat to allow for storage in convenient location. A switch is provided within the handle of the dispenser for activating a motor associated with the pump. A valve is provided for selecting for ejection water or a fluid from the tank.

BRIEF DESCRIPTION OF THE DRAWINGS

FIG. 3(*a*) is a front view of the four chamber tank and pump arrangement of the hemorrhoid treatment system of the present invention.

FIG. 3(*b*) is a rear view of the four chamber tank and pump arrangement of the hemorrhoid treatment system of the present invention.

FIG. 3(*c*) is a top view of the four chamber tank and pump arrangement of the hemorrhoid treatment system of the present invention.

FIG. 3(*d*) is a side view of the four chamber tank and pump arrangement of the hemorrhoid treatment system of the present invention.

FIG. 3(*e*) is a bottom view of the four chamber tank and pump arrangement of the hemorrhoid treatment system of the present invention.

FIG. 4(*b*) is a fragmentary side view of the flow control valve assembly of the hemorrhoid treatment system of the present invention.

FIG. 8(*a*) is a perspective view of the dispenser head of the hemorrhoid treatment system of the present invention in a first operational mode.

FIG. 8(*b*) is a perspective view of the dispenser head of the hemorrhoid treatment system of the present invention in a second operational mode.

FIG. 9 is a schematic diagram of the hydraulic system of the hemorrhoid treatment system of the present invention.

FIG. 10 is a schematic diagram of the electrical system of the hemorrhoid treatment system of the present invention.

DESCRIPTION OF THE INVENTION

Illustrative embodiments and exemplary applications will now be described with reference to the accompanying drawings to disclose the advantageous teachings of the present invention.

Figure 1:
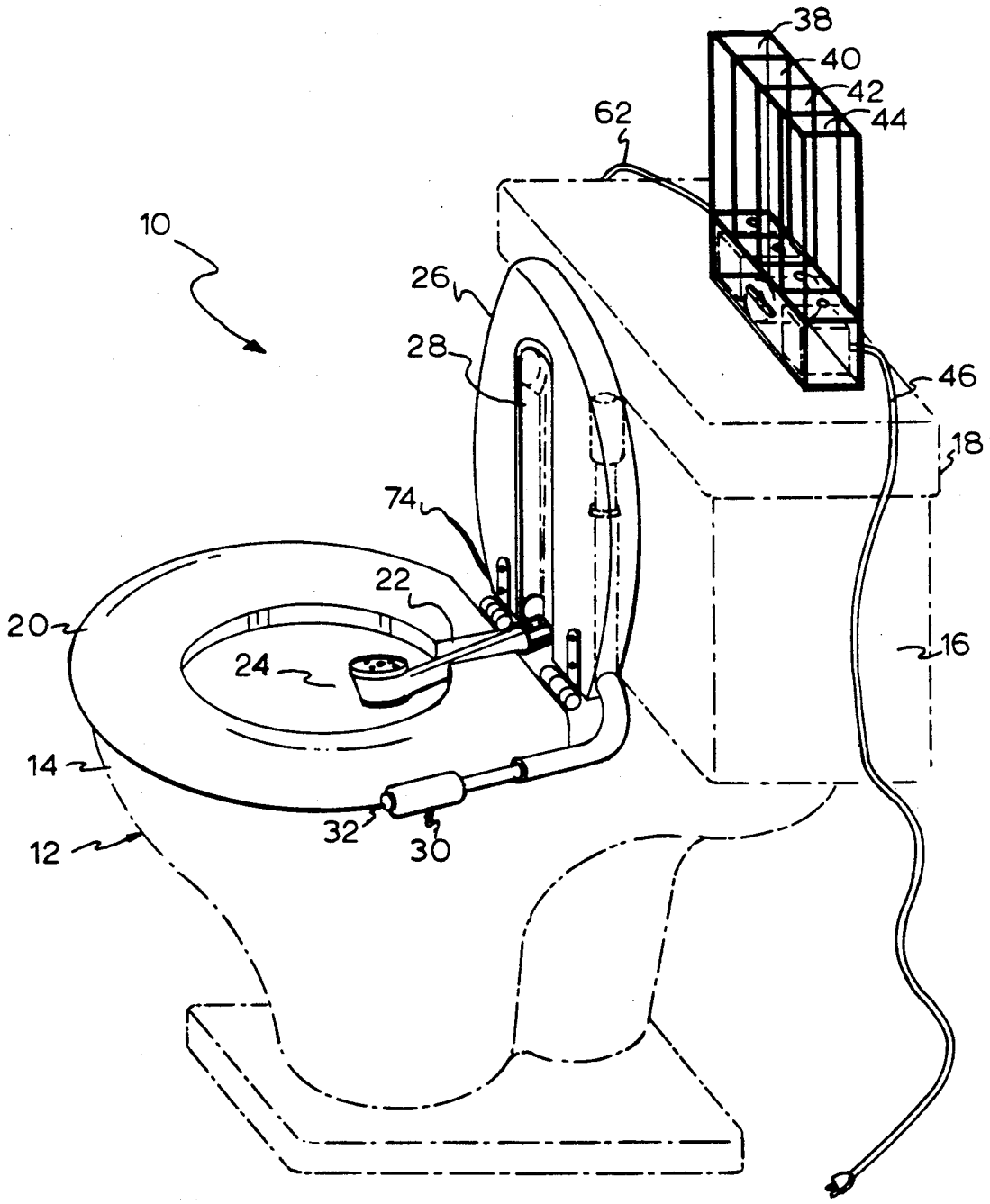
FIG. 1 is a perspective view of the hemorrhoid treatment system of the present invention with the upright position and intended environment shown in phantom.
Figure 2:
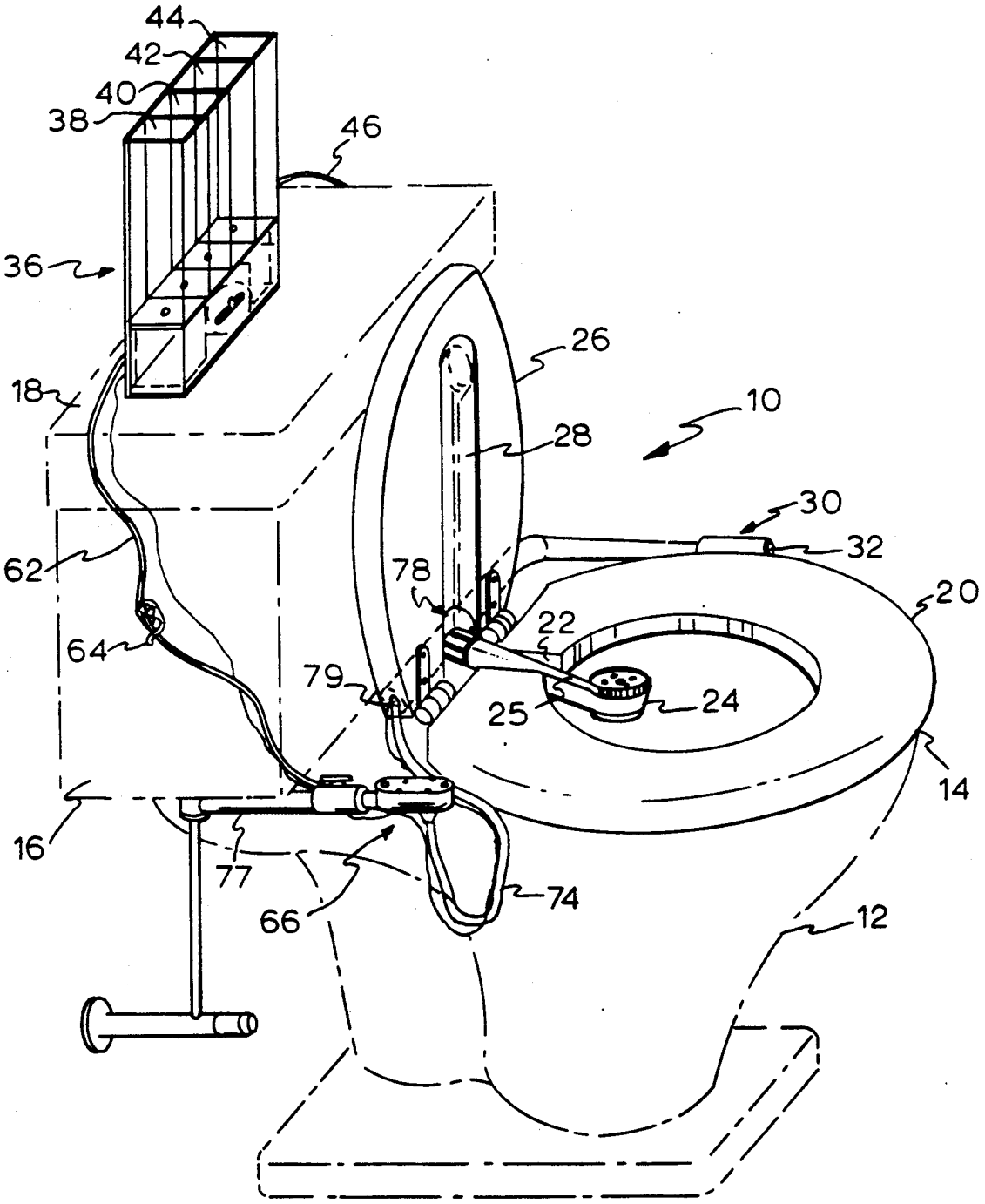
FIG. 2 is a second perspective view of the hemorrhoid treatment system of the present invention with the upright position and intended environment shown in phantom.

FIGS. 1 and 2 show first and second perspective views of the hemorrhoid treatment system 10 of the present invention. The system 10 is adapted for installation on a conventional toilet 12 (shown in phantom). The toilet 12 has a bowl 14, a tank 16 and a lid 18. To accommodate the system of the present invention, the seat 20 of the toilet 12 has a channel 22 cut therethrough at the proximal end thereof. The channel 22 allows the dispenser 24 of the hemorrhoid treatment system 10 to move from a first operational position to a second upright position (shown in phantom). The lid 26 of the seat of the toilet 12 has a recess 28 cut therein which receives the dispenser 24 in the second upright position thereof.

As discussed more fully below and in accordance with the present teachings, in the operational position, the dispenser 24 ejects jets of a selected medication and/or water in an upward direction. The length of the dispenser arm is chosen so that when a patient suffering from hemorrhoids is seated on the toilet 12, the jets of fluid impinge on the affected area. After use, the dispenser 24 is moved from the first operational position to the second upright position by the rigid handle 30. In FIGS. 1 and 2, the handle 30 is shown in the first operational position. The second upright position of the handle is shown in FIG. 1 in phantom. The handle 30 includes a switch 32 at the end thereof. The switch 32 controls the motor of the pump 52 of the system (not shown) as discussed more fully below. The pump 52 is located at the bottom of a tank 36. Power for the electric pump 52 is provided by the cord 46.

In FIG. 1, the tank 36 is adapted to sit on the lid 18 of the tank 16 of the toilet 12. The tank 36 is also adapted to mount on the adjacent wall(s) of the toilet 12. In the preferred embodiment, the tank 36 of the present treatment system 10 would include a cover and be mounted within the tank 16 of the toilet 12. The tank 36 of the treatment system 10 includes four fluid storage chambers 38, 40, 42, and 44. The first fluid storage chamber 38 might contain a cleansing solution or soap, the second might contain a pain medication or topical anesthetic, the third might contain an anti-inflammatory medication and the fourth might contain a solution to increase and strengthen fibrous tissue. (The invention is not limited to the number of storage chambers used nor the medications in each.)

FIG. 3(*a*) shows a front view of the four chamber tank 36 while FIG. 3(*b*) shows a rear view of same. Each of the chambers 38, 40, 42, and 44 of the tank 36 have a volume of medication 39, 41, 43 and 45 respectively. In the preferred embodiment, the tank 36 is constructed of Lucite or other suitably transparent material. The transparency and the reticulation of the frontal surface of each chamber facilitate a visual determination of the level of medication in each chamber.

A bore 48 is provided through the floor of each of the chambers and the lower section 50 of the tank 36 within which the pump motor 52, a selector valve 54 and a transformer 56 are located. In the illustrative embodiment, the lower section 50 is detachable for access and held in place by attachments 49 on both sides of the lower tank 36. Fluid from each of the chambers is provided to the four position selector valve 54 via a small tube 58. The selector valve 54 is a conventional valve which allows for manual selection of the chamber to be connected to the dispenser 24. Hence, as illustrated in the top view of the tank of FIG. 3(*c*), a tube 60 is connected from the output of the selector valve 54 to the input of the pump motor 52.

In the illustrative embodiment, the pump motor 52 is implemented with a 12 volt dc motor such as that used to power automobile window washing systems. The transformer 56 is part of a rectifier circuit (not shown) which serves to convert input ac house current to dc.

As shown more clearly in the perspective view of FIG. 2, a hose 62 communicates the selected medicated fluid from the tank 36 to the dispenser 24 through a flow control valve assembly 66.

Figure 4A:
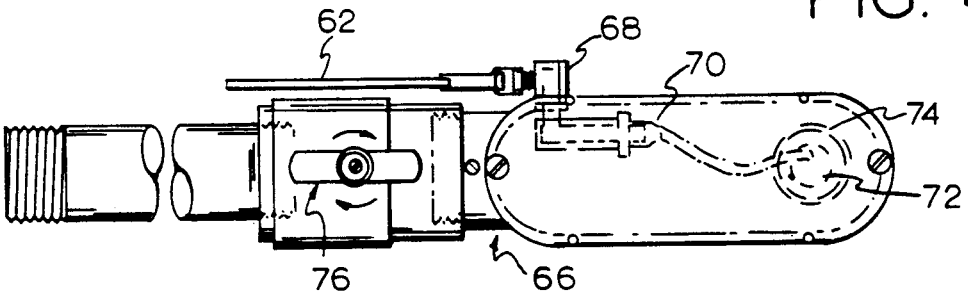
FIG. 4(*a*) is a fragmentary top view of the flow control valve assembly of the hemorrhoid treatment system of the present invention.
Figure 4B:
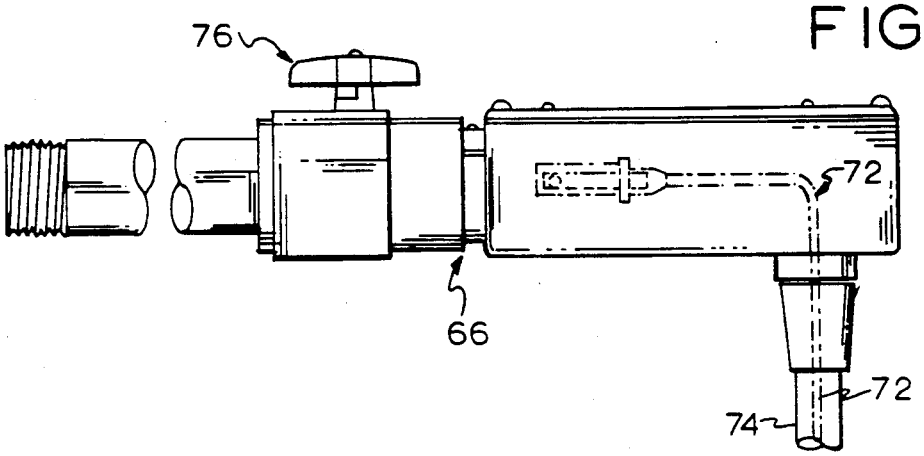

FIG. 4(*a*) is a fragmentary top view of the flow control valve assembly 66 of the hemorrhoid treatment system 10 of the present invention. FIG. 4(*b*) is a fragmentary side view of the flow control valve assembly 66 of the hemorrhoid treatment system 10 of the present invention. As shown in FIG. 4(*a*), the hose 62 from the tank 36 is connected to the valve 66 via a coupling 68. An internal coupling arrangement connects the hose 62 to the center tube 72 of a tube within a tube hose 74. The hose 74 is, in turn, connected to the dispenser 24. A manually actuatable flow control valve 76 is mounted in-line between the hose 74 and a source of water. See also the fragmentary side view of FIG. 4(*b*).

Figure 5:
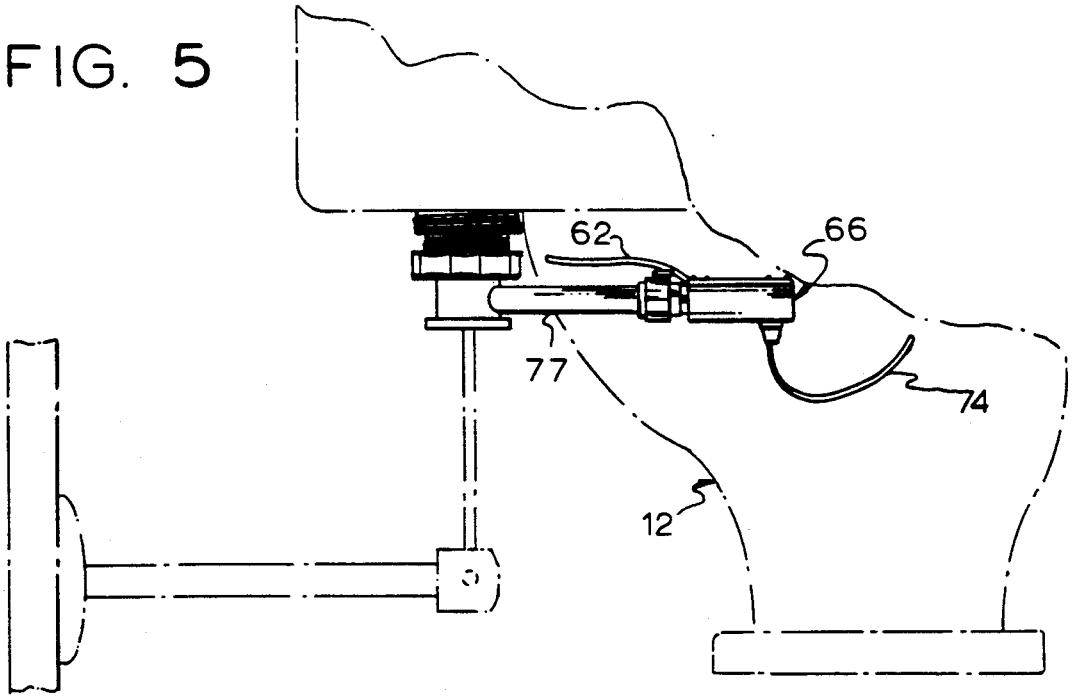
FIG. 5 is a side view of an illustrative coupling arrangement of the hemorrhoid treatment system of the present invention to the input water source of a conventional toilet.

As illustrated in FIG. 5, the flow control valve assembly 66 is connected to the water supply by a pipe 77. When the flow control valve 76 is open, water flows through the hose 74 about the inner tube thereof. Fluid flow from the tank 36 may be restricted in the inner tube by a pinch valve 64 (see FIG. 2). The pinch valve serves to prevent continuous dribbling of the medications in the tank when the pump is not in use.

As shown in FIG. 2, the hose 74 is connected to the dispenser 24 through a tubular T-shaped support 78 shown primarily in phantom in the lower portion of the lid 26 of the seat of the toilet 12. The support 78 rigidly connects the handle 30, connected at one end, to the dispenser arm 25, which is connected in the middle of the support 78. The support 78 is pivotally mounted within the seat lid 26 so that movement of the handle 30 from the first position to the second position translates to movement of the dispenser arm 25 and dispenser 24 from the first position to the second position accordingly. The support 78 may be made of plastic, metal or other suitable material. The hose 74 is connected to the support 78 through an opening 79 in the seat lid 26.

Figure 6:
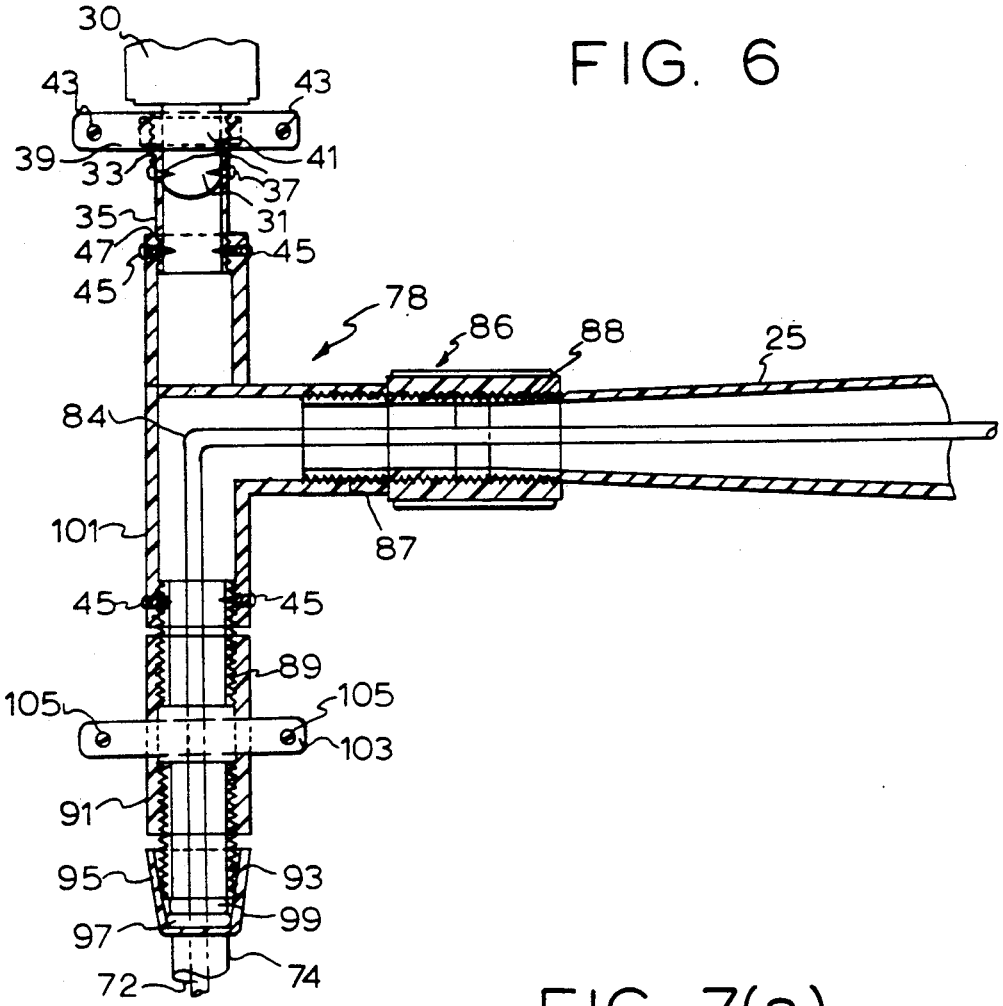
FIG. 6 is a top sectional view of the tubular T-shaped support of the hemorrhoid treatment system of the present invention.

FIG. 6 is a top sectional view of the tubular T-shaped support 78 of the hemorrhoid treatment system of the present invention. As shown in FIG. 6, the support 78 transfers inner tube 72 through a right angle bend 84 through the dispenser arm 25 to the dispenser head 24. The support and the dispenser arm 25 are hollow to accommodate the flow of water around the inner tube 72. The handle 30 is connected to the support 78 through a protrusion 31. In the illustrative embodiment, the protrusion 31 from the handle 30 is secured to an extension pipe 35, which extends from the support 78, via screws 37. The extension pipe 35 has threads 33 which engage matching threads 39 inside a circular bracket 41. The bracket 41 is secured to the seat lid 26 via screws 43. The proximal end of the extension pipe 35 is secured to the main body of the support 78 by locking screws and threads 45 and 47 respectively.

The dispenser arm 25 threadably engages the support 78 via a coupling 86 at a threaded end 88. The coupling 86 is secured to the support 78 via a threaded connector 87. A second threaded connector 89 is used to secure the lower end of the support 78 to the outer tubing 74 via a double ended threaded coupling 91, a third threaded connector 93, and a screw-on cap 95. Each of these elements is hollow to allow fluid flowing in the outer tubing 74 to flow to the dispenser 25. The outer tubing extends through an opening in the end cap 95 and is terminated by flaring 97. The flaring 97 secures the tubing 74 within the end cap 95. A rubber washer 99 is fitted within the end cap 95 between the flaring 97 and the third threaded connector 93. The inner diameter of the washer 99 is large enough to permit fluid flowing in the outer tubing to flow therethrough through the third connector 93, the second coupling 91, the second connector 89, the hollow-T 101, the first connector 87 and the first coupling 86 to the dispenser 25. The smaller inner tube 72 transverses the same path to the dispenser 25 as discussed below. The proximal end of the support is secured by the second coupling 91 to the seat 26 via a mounting bracket 103 and associated screws 105. The coupling elements and mounting brackets retain the support 78 in place within the seat lid 26 throughout the range of motion of the support 78.

Figure 7A:
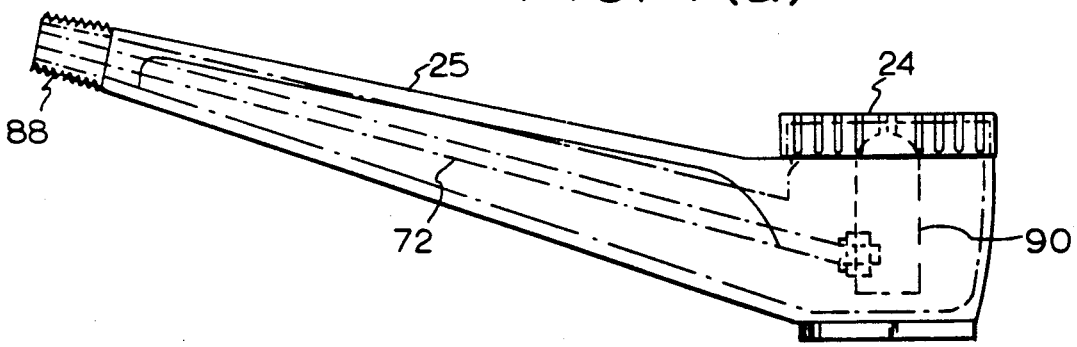
FIG. 7(*a*) is a side view of the dispenser head of the hemorrhoid treatment system of the present invention FIG. 7(*b*) is a top view of the dispenser head of the hemorrhoid treatment system of the present invention.
Figure 7B:
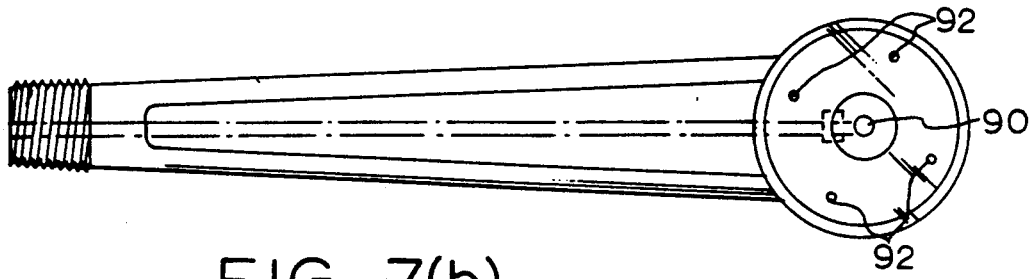

As illustrated in the side view of FIG. 7(*a*) and the top view of FIG. 7(*b*), the inner tube 72 is shown in phantom within the hollow interior of the dispenser arm 25 and dispenser head 24. The inner tube is connected to the center eyelet 90 of the dispenser head 24. Thus, medicated spray is provided through the center eyelet 90 of the dispenser head 24 as illustrated in FIG. 8(*a*). The remaining eyelets 92 of the dispenser head 24 communicate with the hollow interior of the dispenser arm 25 such that water is allowed to flow therethrough as illustrated in FIG. 8(*b*).

A schematic diagram of the hydraulic subsystem 94 of the hemorrhoid treatment system 10 is provided in FIG. 9. As discussed above, when the switch 32 is activated, the pump motor 52 is energized via a conductor 96. When the pump motor 52 is energized, the medication selected by the selector valve 54 is pumped through the tube 62 and the pinch valve 64 to the flow control valve 66. Assuming the flow control valve is closed, the medication flows along the inner conductor 72 through the support 78, dispenser arm 25 and out of the dispenser head 24 via the center eyelet 90. When water is the desired fluid, the pinch valve 64 is closed, the flow control valve 66 is open and water flows under pressure around the center tube 72, within the hose 74, through the support 78 and dispenser arm 25, ultimately exiting the dispenser head 24 from the eyelets 92. The flow control valve can be on when the medication is flowing so that water and medication can flow simultaneously.

An electrical schematic is provided in FIG. 10. The switch 32 is shown connected to the pump motor 52. Direct current is supplied to the pump motor 52 is provided by the transformer rectifier circuit 56 from a common wall outlet.

Thus, the present invention has been described herein with reference to a particular embodiment for a particular application. Those having ordinary skill in the art and access to the present teachings will recognize additional modifications applications and embodiments within the scope thereof. For example, the invention is not limited to any particular number of storage chambers for the tank nor the medications stored therein. The invention is not limited to the scheme shown for pumping the medication to the dispenser. Nor is the invention limited in use to treating hemorrhoids.

It is therefore intended by the appended claims to cover any and all such applications, modifications and embodiments within the scope of the present invention.

Accordingly,

What is claimed is:

1. A hemorrhoid treatment system comprising:

tank means for storing a first fluid;

dispenser means located in a toilet seat for ejecting said fluid, said dispenser means including a T-shaped tubular support having a first portion extending along a first longitudinal axis and mounted for rotational motion in a lid of said toilet seat, said first portion having first and second fluid flow paths therein, said tubular support having a tubular dispenser arm extending along a second axis normal to said longitudinal axis from a middle section of said tubular T-shaped support, said first and second fluid flow paths extending through said dispenser arm and said dispenser arm being terminated with a dispenser head having two sets of eyelets, each set of eyelets being in fluid communication with exactly one of said fluid flow paths; and pump means for pumping fluid from said tank through said dispenser means.

2. The invention of claim 1 wherein said first fluid flow path is in communication with said tank means and said second fluid flow path is in communication with an external source of fluid.

3. The invention of claim 2 further including valve means for controlling the flow of said first fluid in said first fluid flow path.

4. The invention of claim 3 further including second valve means for controlling the flow of said external fluid in said second fluid flow path.

5. The invention of claim 3 wherein said tubular support is connected to said first and second valve means on a first end thereof and to a handle on a second end thereof such that movement of said handle from a first position to a second position is effective to move said dispenser head from a first operational position to a second position.

6. The invention of claim 4 wherein said toilet seat has a channel adapted to receive said dispenser head when said dispenser head is in said first position.

7. The invention of claim 4 wherein said lid of said toilet seat has a recess adapted to receive said dispenser head when said dispenser head is in said second position.

8. The invention of claim 4 wherein said pump means includes an electrical motor actuatable by a switch disposed in said handle.

9. The invention of claim 1 wherein said tank means includes plural storage chambers.

* * * * *